US006604845B2

(12) United States Patent
Golz

(10) Patent No.: US 6,604,845 B2
(45) Date of Patent: Aug. 12, 2003

(54) DISPLAY LAMP WITH OPTICALLY CURVED HEAT SHIELD

(75) Inventor: Thomas M. Golz, Willoughby Hills, OH (US)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 09/858,061

(22) Filed: May 15, 2001

(65) Prior Publication Data

US 2002/0171345 A1 Nov. 21, 2002

(51) Int. Cl.[7] ..... F21V 7/20
(52) U.S. Cl. ..... 362/345; 362/294; 313/113
(58) Field of Search ..... 313/113, 318.11; 362/345, 294, 373, 264, 293

(56) References Cited

U.S. PATENT DOCUMENTS 4,707,632 A 11/1987 Walsh ..... 313/112
4,780,799 A 10/1988 Groh ..... 362/294
4,885,668 A * 12/1989 Maglica et al. ..... 362/345
5,680,000 A 10/1997 Zuk et al. ..... 313/25
5,757,134 A 5/1998 Williamson ..... 313/613
5,951,151 A * 9/1999 Doubeck et al. ..... 362/294

* cited by examiner

*Primary Examiner*—Sandra O'Shea
*Assistant Examiner*—Bao Truong
(74) *Attorney, Agent, or Firm*—Pearne & Gordon LLP

(57) ABSTRACT

A low voltage display lamp is provided for use in standard threaded lamp sockets. The lamp has a heat shield to reflect infrared radiation (IR) away from the ballast to reduce the ballast's operating temperature. The surface of the heat shield is optically curved to direct the reflected IR back through the front of the lamp such that it exits through the transparent cover rather than being reflected into the lamp housing.

23 Claims, 1 Drawing Sheet

DISPLAY LAMP WITH OPTICALLY CURVED HEAT SHIELD

BACKGROUND OF THE INVENTION

This invention relates to display lamps. More particularly, it relates to low voltage display lamps having a heat-reducing heat shield with an optically curved surface.

Low voltage display lamps are known in the art. Low voltage display lamps for use in standard lamp sockets having line-voltage, such as, e.g., the well known MR16 lamps, comprise a reflector assembly that works in conjunction with a voltage converter such as solid state electronic ballast. The ballast is contained within a lamp housing together with, disposed in close proximity to and directly behind the reflector assembly. Consequently, it is important to minimize radiant heat from the reflector assembly to the ballast in order to ensure proper operation and a long service life.

Current display lamp designs employ a flat circular heat shield or plate which is disposed behind the elliptical reflector of the reflector assembly and in front of the ballast. This heat shield serves to protect the ballast by reflecting infrared radiation (IR) generated by the filament and transmitted through the reflector, thereby reducing the ballast's operating temperature. However, a significant portion of the reflected IR is directed at the interior surface of the lamp housing. Consequently, the lamp housing, which is already subject to direct IR energy from the filament, now absorbs roughly twice the IR compared to that radiated directly from the filament to the housing.

The result is that the housing is more susceptible to melting from absorbed IR, and also that the absorbed IR will be conducted as heat through the housing material to the ballast, thereby raising the ballast operating temperature and shortening its service life.

Existing means for solving the problem of ballast heating include multi-layer coatings applied to the concave reflector surface that are designed to reflect IR instead of transmit it through the reflector toward the ballast. However, such coatings are difficult to design and apply correctly and often are very expensive. Most such coatings involve applying a discrete coating layer separate from the reflective coating layer, thereby contributing an additional coating process. It has been further suggested that a broad-band dichroic coating that would reflect in both the visible and IR spectra could be used, however such a coating would be difficult to apply correctly, and could adversely affect the lumen efficiency of the lamp.

There is a need in the art for a low voltage display lamp, for use in standard line-voltage electric lamp sockets, comprising an efficient heat shield that effectively reflects IR away from the ballast, and also that does not direct such reflected IR energy toward the lamp housing. Preferably, such a heat shield will reflect IR energy back through the lamp reflector to exit the lamp through the lamp cover. Such a heat shield will effectively reduce the ballast operating temperature.

SUMMARY OF THE INVENTION

A low voltage display lamp is provided having a lamp housing, a reflector assembly, a solid state electronic ballast, and a heat shield. The reflector assembly has a light source and is located within the housing, with the ballast located behind the reflector assembly. The heat shield is located between the ballast and the reflector assembly, and has an optically curved surface.

DETAILED DESCRIPTION OF THE PREFERRED EMBODIMENTS OF THE INVENTION

In the description that follows, when a preferred range, such as 5 to 25 (or 5–25) is given, this means preferably at least 5, and separately and independently, preferably not more than 25.

As used herein, "MR16" means a low voltage display lamp as is generally known in the art, having a nominal diameter of two inches.

Figure 1:
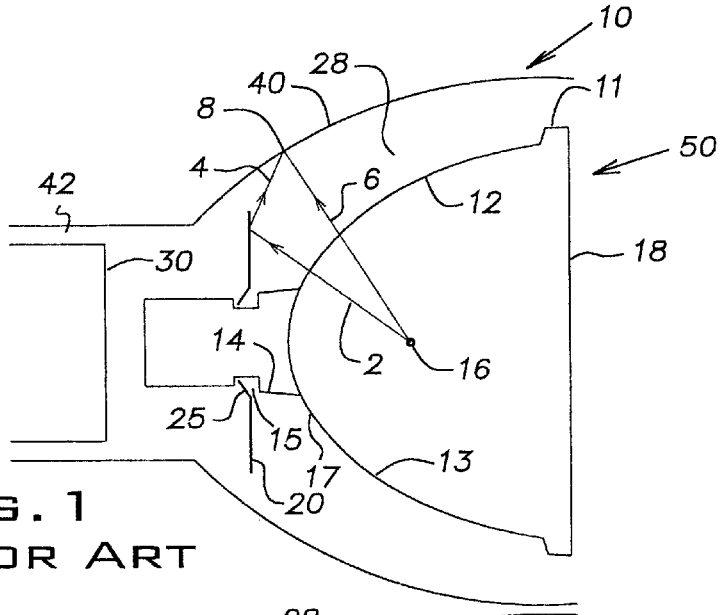
FIG. 1 PRIOR ART
FIG. 1 is a schematic side view of a low voltage display lamp having a flat circular heat shield characteristic of the prior art.

With reference to FIG. 1, pictured is a characteristic or conventional low voltage display lamp 10. The lamp 10 comprises a solid state ballast 30 and a reflector assembly 50, both contained within a lamp housing 40. Lamp 10 further comprises socket coupling means (preferably threaded) for electrically coupling the electronic ballast 30 to a lamp socket (not shown). The ballast 30 is disposed in the throat 42 of the housing 40 directly behind the reflector assembly 50. The reflector assembly 50 preferably comprises a curved reflector 12, preferably ranging from substantially elliptical to substantially parabolic in shape, a filament or light source 16, and a transparent cover plate 18. The reflector 12 has an outer surface, and a concave inner surface 13 onto which is coated a light-reflective coating layer (not shown). The reflector 12 typically comprises a borosilicate glass material. The light source 16 is disposed within the reflector 12, facing concave inner surface 13. During operation, light source 16 of reflector assembly 50 is electrically coupled to ballast 30 via metal pins, wires, or some other known means (not shown). The reflector 12 terminates in a rim 11 forming the entire perimeter of the open end of the reflector 12.

Figure 2:
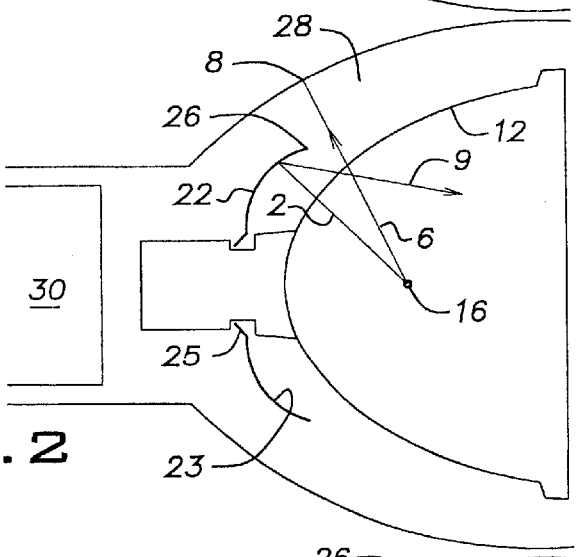
FIG. 2 is a schematic side view of a low voltage display lamp having a heat shield according to a first preferred embodiment of the present invention.
Figure 4:
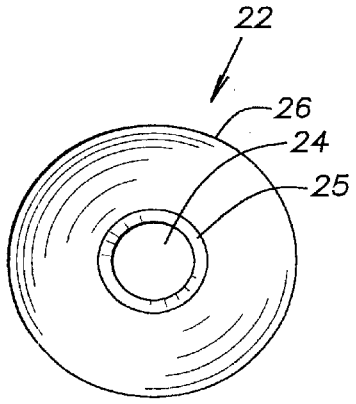
FIG. 4 is a plan view of a heat shield according to the present invention.
Figure 3:
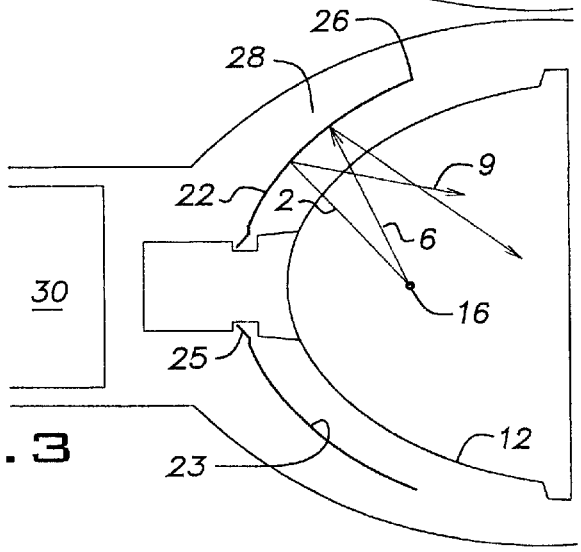
FIG. 3 is a schematic side view of a low voltage display lamp having a heat shield according to a second preferred embodiment of the present invention.

The lamp 10 preferably further comprises a nose or boss 14 formed integrally with and extending outwardly from the outer surface of the base 17 of the reflector 12. The boss 14 preferably has a rectangular cross-section, though cross-sections of other shapes are possible and can be used. Preferably, the reflector 12 and the boss 14 are integrally formed from glass, preferably borosilicate glass. The boss 14 has a depression or groove 15 along its surface. Preferably, the groove 15 is on two opposing sides of a rectangular boss 14, though other groove configurations, e.g. a perimeterized groove, are possible and may be used. The lamps of FIGS. 2 and 3 are of this same general construction.

With reference to FIG. 1, a heat shield 20 characteristic of the prior art is shown. The heat shield is positioned between base 17 of reflector 12 and ballast 30 in order that the heat shield reflects IR transmitted through the reflector 12 away from the ballast 30. The heat shield 20 typically is formed from a flat circular disk of material, preferably a metal having good IR reflective properties. A hole or opening 24 is disposed at the center of the heat shield 20. Preferably, the opening 24 is rectangular in shape to accommodate the shape of the boss 14, allowing the boss 14 to pass therethrough. Less preferably, the opening can be of any other shape to accommodate a boss having a differently shaped cross-section.

Securing means 25 are disposed at the perimeter of opening 24 for securing the heat shield 20 to the reflector assembly 50 in a fixed position relative thereto. The securing means 25 can be any securing means known in the art that will effectively couple the heat shield 20 to the groove 15 in boss 14. Preferably, the securing means 25 is an interference fit and is formed integrally with the heat shield 20, said securing means being a portion of the heat shield material at the perimeter of opening 24, the material being cut, shaped or configured to form said securing means 25 to mate with groove 15 in securing the heat shield 20. Less preferably, the boss 14 can be provided without a groove, and the heat shield 20 secured to the boss 14 by some other means known in art, for example with an adhesive, mechanical attachment or an interference fit between opening 24 and boss 14. Optionally, the heat shield 20 can be provided fixed to the interior of housing 40 by any suitable securing means, e.g. clips or fasteners, such that the heat shield serves the secondary function of retaining the reflector assembly 50 in housing 40 once the heat shield 20 is secured to boss 14 as described herein. In the alternative, separate securing means known in the art for retaining the reflector assembly 50 in housing 40 will be required, and can be provided.

As can be seen in FIG. 1, a flat heat shield 20 as described above reflects incident radiation 2, and directs it as reflected radiation 4 toward a point 8 along the interior surface of the lamp housing 40. In addition to the reflected radiation 4, point 8 also receives direct radiation 6 from light source 16. Hence the reflected radiation 4 effectively doubles or increases the absorbed IR load at point 8, thereby significantly increasing the localized housing temperature around point 8. It will be understood that such double or enhanced absorption is not a discretized effect around a single point 8 as portrayed in FIG. 1. Discrete point 8 is pictured merely for illustration. This double or enhanced absorption phenomenon occurs along the interior surface of housing 40, thereby significantly increasing its temperature.

Increased housing temperature increases the danger of housing meltdown, requiring that housing materials having high softening or melting points must be used. In addition, absorbed IR is conducted as heat through the housing back to the throat portion 42 which encloses the ballast 30. The conducted energy is then transferred to the ballast via conduction through the physical pathways between the ballast 30 and the housing 40, and via radiation from the housing 40 to the ballast 30. Additionally, thermal currents transfer thermal energy to the ballast via convection as known in the art. Thermal energy transferred to the ballast 30 via the above mechanisms raises the ballast's operating temperature thereby reducing its service life, thus lowering the functional efficiency of the heat shield 20.

Now referring to FIG. 2, the flat circular disk shaped heat shield 20 is replaced with the invented heat shield 22 that has an optically curved surface 23. The optically curved surface 23 of invented heat shield 22 is concave. Curved surface 23 is designed to direct reflected energy back through reflector 12, preferably without directing substantial reflected energy at rim 11, such that reflected energy exits the lamp through clear cover 18. Preferably, curved surface 23 is parabolic, less preferably elliptical, less preferably spherical, less preferably any other suitable optically curved concave shape. The optically curved surface 23 prevents direct IR radiation to the ballast 30 by reflecting IR away from the ballast 30. Preferably, the invented heat shield 22 is or comprises aluminum. Less preferably, the heat shield 22 comprises a stainless steel substrate having a reflective coating of aluminum, less preferably gold, less preferably nickel, less preferably an IR reflective dichroic coating as known in the art, less preferably some other IR reflective coating material. Optionally, the heat shield 22 comprises a substrate of any other temperature resistant material, such as a metal or metal alloy, having a high melting point (for example greater than 200° F.), e.g. aluminum, titanium or tungsten, coated with an IR reflective layer of aluminum, less preferably gold, less preferably nickel, less preferably some other reflective coating material. Least preferably, the heat shield 22 comprises stainless steel with no reflective coating, less preferably any other suitable material known in the art. The invented heat shield 22 is provided similarly to the prior art heat shield 20 in other respects as described above with respect to FIG. 1.

As can be seen in FIG. 2, incident radiation 2 is directed back through reflector 12 as reflected radiation 9, such that the reflected radiation 9 exits the lamp through transparent cover 18 as shown. The transparent cover 18 preferably transmits nearly 100% of the reflected IR, absorbing almost none. Consequently, the reflected IR escapes the lamp, and therefore is not absorbed by the lamp housing 40, raising its temperature.

In a first preferred embodiment, the invented heat shield 22 has a diameter large enough to prevent direct radiation of IR to the ballast 30, said diameter being substantially equal to or slightly greater than (preferably less than 1, 3, 5, 8, 10, 15, 20, 30, 40, 50, 70, 90, or 100, mm greater than) the interior diameter of the throat portion 42 of lamp housing 40.

In a second preferred embodiment as shown in FIG. 3, the invented heat shield 22 extends through the annular space 28 between reflector 12 and housing 40 toward rim 11, thereby also reflecting direct radiation 6 away from the housing 40 and out the lamp through transparent cover 18. It will be understood that there exists an optimum distance to which the heat shield 22 terminus can be extended forward as here described, beyond which no appreciable or material temperature reduction will be achieved per additional length of forward extension of heat shield 22. It is believed that such optimum distance is achieved when the terminal edge 26 of heat shield 22 is substantially coplanar with the center of light source 16 as evident from FIG. 3, or less preferably within 1, 2, 3, 4, 6, 8, 10, 15, or 20, mm of being coplanar (i.e. either short or long of being coplanar) with the center of light source 16. It is believed that a heat shield 22 so defined will efficiently reduce the operating temperature of lamp 10 and ballast 30, and that additional heat shield length will result in only negligible or immaterial additional temperature reduction. In this embodiment, the curved portion of heat shield 22 is positioned less than 50% of the distance from reflector 12 to the curved portion of housing 40, such that the curved portion of heat shield 22 is closer to reflector 12 than to the curved portion of housing 40; preferably the distance between the curved portion of heat shield 22 and the reflector 12 is a substantially uniform distance; i.e. the gap is a substantially uniform gap. Preferably, at least 15, 20, 25, 30, 40, 50, 60, 70, 80, 90, or 95,% (on a surface area basis) of the curved portion of heat shield 22 is located within 10–50, more preferably 15–50, more preferably 20–50, more preferably 25–50, more preferably 30–50,% of the distance from reflector 12 to the curved portion of housing 40 in annular space 28. For example, the annular space 28 in an MR16 lamp according to the present invention has a thickness of preferably 1–10, more preferably 1.5–8, more preferably 2–6, more preferably 2.5–4, more preferably about 3, mm. The terminal edge 26 of invented heat shield 22 and also the other portions of the curved portion of heat shield 22 in such an MR16 lamp is preferably 0.3–1.5, more preferably 0.45–1.5, more preferably 0.6–1.5, more preferably 0.75–1.5, more preferably 0.9–1.5, mm from reflector 12 when thickness of annular space 28 is 3 mm. It will be noted that these ranges correspond to preferable proportionate distances listed above for positioning the heat shield in proximity to reflector 12 relative to the total distance between reflector 12 and the curved portion housing 40. The same ratios should be used for positioning heat shield 22 in lamps where the thickness of annular space 28 differs from 3 mm. For example, where the annular thickness is 10 mm, the most preferable position for the terminal edge 26 and the curved portions of heat shield 22 is 3–5 mm from reflector 12. It should be noted that the heat shield 22 may be curved slightly inward near its terminal edge 26 to avoid directing reflected energy at rim 11.

Positioning the heat shield 22 in this manner reduces the amount of radiant energy from the heat shield 22 to housing 40. Though the radiant energy load to reflector 12 is increased via proximate location of heat shield 22, reflector 12 1) is preferably a borosilicate glass material and is better able to sustain radiative heating from the heat shield, and 2) has an available mechanism for dissipating absorbed heat through transparent cover 18 and out of the lamp.

Whether according to the first or second preferred embodiment described above, the optically curved surface 23 is shaped (optically designed) such that the resulting incident angle at each discrete point along the heat shield surface 23, relative to light source 16, defines a reflection angle whereby the incident radiation from light source 16 to said discrete point is reflected back through reflector 12 to exit the lamp through transparent cover 18. There preferably exist no or few points on heat shield surface 23 having an incident angle that will direct reflected radiation from light source 16 toward housing 40. An optically curved surface defined in this manner achieves maximum heat shield efficiency, ensuring the lowest possible overall operating temperature for lamp 10, and particularly for ballast 30.

It is believed that the invented heat shield 22 will decrease the ballast temperature by 5–10° C. Current MR16 lamps operate in the range of 20–71 watts (W). The higher the wattage, the greater the light output of the lamp. Ballasts used in conjunction, and in close proximity, with 20W MR16 lamps operate near threshold temperature due to the transfer of heat from the light source 16 to the ballast 30 via the various mechanisms described above. The invented heat shield 22 allows a ballast to be incorporated into a housing in close proximity, with higher wattage MR16 lamps, (e.g. at least or about 35W, 45W, 55W, 65W, or 71W), and to operate sufficiently below its threshold temperature to ensure a long life, rated at preferably more than 3000, preferably 3500, preferably 4000, preferably 4500, preferably 5000, hours.

Though the above-described preferred embodiment has been described with regard to an MR16 lamp, it will be understood that the invention could be applied to display lamps of different shapes and sizes without departing from the scope of the invention. For example, the invented optically curved heat shield 22 can be utilized in MR8, MR11, MR20, MR30, MR38, PAR16, PAR20, PAR30, and PAR38 display lamps, as well as any other reflector lamp known in the art, and would be similarly provided and comprised as described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A low voltage display lamp comprising a lamp housing, a reflector assembly, a solid state electronic ballast, and a heat shield, said reflector assembly comprising a reflector and a light source, and being disposed within said housing, said ballast being disposed behind said reflector assembly within said housing, said heat shield being disposed between said ballast and said reflector assembly, said heat shield comprising an optically curved surface and being effective to reflect at least a portion of IR radiation emitted from said light source back through said reflector to exit said display lamp.

2. A lamp according to claim 1, said heat shield having an opening therethrough at a center thereof and further comprising securing means at a perimeter of said opening, said reflector assembly further comprising a reflector and a boss extending outwardly from a base of said reflector, said opening through said heat shield adapted to accommodate said boss, said boss having a groove cooperating with said securing means of said heat shield to secure said heat shield to said boss.

3. A lamp according to claim 1, wherein said heat shield comprises aluminum.

4. A lamp according to claim 1, wherein said heat shield comprises a substrate of stainless steel coated with an IR reflective layer.

5. A lamp according to claim 4, wherein said IR reflective layer is aluminum.

6. A lamp according to claim 4, wherein said IR reflective layer is gold.

7. A lamp according to claim 4, wherein said IR reflective layer is nickel.

8. A lamp according to claim 1, wherein said optically curved surface of said heat shield is concave.

9. A lamp according to claim 1, wherein said optically curved surface of said heat shield is substantially parabolic in shape.

10. A lamp according to claim 1, wherein said optically curved surface of said heat shield is substantially elliptical in shape.

11. A lamp according to claim 1, wherein said optically curved surface is effective to direct reflected energy through said reflector to exit said lamp.

12. A lamp according to claim 1, wherein said reflector assembly cooperates with said housing to form an annular space therebetween, said heat shield having a terminal edge and extending forward within said annular space, said terminal edge of said heat shield being within 10 mm of being coplanar with the center of said light source.

13. A lamp according to claim 1, wherein said reflector assembly cooperates with said housing to form an annular space therebetween, said heat shield having a terminal edge and extending forward within said annular space, said terminal edge of said heat shield being substantially coplanar with the center of said light source.

14. A lamp according to claim 1, wherein at least 25% of the surface area of the curved portion of said heat shield is disposed 10–50% of the distance from said reflector to the curved portion of said housing, said distance measured from said reflector.

15. A lamp according to claim 1, wherein said heat shield is secured directly to said housing.

16. A lamp according to claim 2, wherein said boss is formed integrally with said reflector.

17. A lamp according to claim 2, wherein said reflector is substantially parabolic in shape.

18. A lamp according to claim 1, said light source being at least a 45 watt light source.

19. A lamp according to claim 1, said light source being at least a 55 watt light source.

20. A lamp according to claim 1, said light source being at least a 45 watt light source, said lamp having a rated life of more than 4000 hours.

21. A lamp according to claim 1, said light source being at least a 35 watt light source, said ballast being operable below a threshold temperature thereof such that said lamp has a rated life of more than 3000 hours.

22. A lamp according to claim 1, said reflector terminating in a substantially circular rim at an open end of said reflector, said optically curved surface of said heat shield directing substantially no reflected IR radiation at said rim.

23. A lamp according to claim 1, said lamp having a rated life longer than 3000 hours.

* * * * *